US010400481B2

(12) United States Patent
Wong

(10) Patent No.: US 10,400,481 B2
(45) Date of Patent: Sep. 3, 2019

(54) FINGERPRINT LOCK

(71) Applicant: BIO-KEY HONG KONG LIMITED, Jiang Men (CN)

(72) Inventor: Kwok Fong Wong, Hong Kong (CN)

(73) Assignee: BIO-KEY HONG KONG LIMITED, Jiang Men (CN)

( * ) Notice: Subject to any disclaimer, the term of this patent is extended or adjusted under 35 U.S.C. 154(b) by 0 days.

(21) Appl. No.: 15/634,352

(22) Filed: Jun. 27, 2017

(65) Prior Publication Data

US 2018/0051489 A1 Feb. 22, 2018

(30) Foreign Application Priority Data

Aug. 21, 2016 (CN) ..... 2016 1 0698250

(51) Int. Cl.

| | |
|---|---|
| ***E05B 67/06*** | (2006.01) |
| ***G07C 9/00*** | (2006.01) |
| ***E05B 17/10*** | (2006.01) |
| ***E05B 47/00*** | (2006.01) |

(Continued)

(52) U.S. Cl.

CPC ..... *E05B 67/06* (2013.01); *E05B 17/002* (2013.01); *E05B 17/10* (2013.01); *E05B 47/00* (2013.01); *E05B 67/22* (2013.01); *G07C 9/00087* (2013.01); *G07C 9/00174* (2013.01);

(Continued)

(58) Field of Classification Search

CPC ..... G07C 9/00087; G07C 9/00071; G07C 9/00563; G07C 9/00174; E05B 67/22; E05B 67/10; E05B 67/14; E05B 67/06; E05B 17/10; E05B 47/00; E05B 17/002; E05B 2047/0058; E05B 47/0012

USPC ..... 70/20, 38 B, 38 C, 277, 278.1, 278.7, 70/279.1, 282

See application file for complete search history.

(56) References Cited

U.S. PATENT DOCUMENTS

| | | | | |
|---|---|---|---|---|
| 7,948,359 | B2 * | 5/2011 | Marcelle ..... | G07C 9/00182 340/5.64 |
| 8,353,187 | B2 * | 1/2013 | Woodling ..... | E05B 47/0603 70/20 |
| 9,784,016 | B1 * | 10/2017 | Cabral Herrera ... | E05B 47/0012 |

(Continued)

*Primary Examiner* — Lloyd A Gall

(74) *Attorney, Agent, or Firm* — Brundidge & Stanger, P.C.

(57) ABSTRACT

A fingerprint lock is disclosed herein, comprising a lock hook and a lock body, wherein the lock body comprises an upper housing, a lower housing, a main body and a fingerprint sensor component, the main body is located between the upper housing and the lower housing, and the upper housing is provided with a first opening; the main body comprises a battery, a main board, a bracket, a speed-reducing motor, a cam, a lock tongue and a pin, and the speed-reducing motor is mounted on the main board through the bracket, the battery, main board, bracket and speed-reducing motor are located between the upper housing and the lower housing in sequence, and the lock tongue is connected to one end of the speed-reducing motor through the cam; the fingerprint sensor component comprises a sensor body and a sensor cover, the sensor body being located between the battery and the sensor cover, and the sensor cover being matched with the first opening and clamped in the first opening; a first end of the lock hook is provided with a spring, and the first end is connected with the lock tongue by a snap spring and a movable touch block.

9 Claims, 1 Drawing Sheet

(51) Int. Cl.
*E05B 17/00* (2006.01)
*E05B 67/22* (2006.01)

(52) U.S. Cl.
CPC ..... *G07C 9/00563* (2013.01); *E05B 47/0012* (2013.01); *E05B 2047/0058* (2013.01)

(56) References Cited

U.S. PATENT DOCUMENTS

| | | | | |
|---|---|---|---|---|
| 2007/0096870 | A1* | 5/2007 | Fisher | E05B 19/0005 340/5.53 |
| 2007/0126551 | A1* | 6/2007 | Slevin | E05B 67/00 340/5.53 |
| 2008/0012686 | A1* | 1/2008 | Bonestroo | E05B 47/00 340/5.53 |
| 2009/0282876 | A1* | 11/2009 | Zuraski | E05B 67/003 70/35 |
| 2011/0050419 | A1* | 3/2011 | Ng | E05B 39/00 340/542 |
| 2013/0055773 | A1* | 3/2013 | Li | E05B 47/06 70/278.1 |
| 2014/0375422 | A1* | 12/2014 | Huber | G07C 9/00174 340/5.61 |
| 2017/0009491 | A1* | 1/2017 | Nguyen | E05B 67/10 |
| 2017/0198497 | A1* | 7/2017 | Tsai | E05B 67/00 |

* cited by examiner

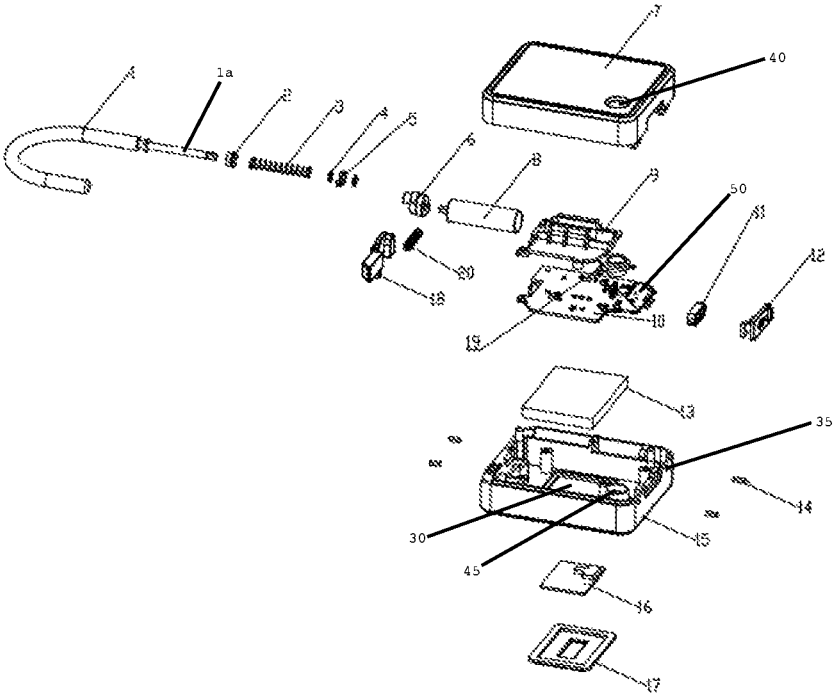
1a
40
50
35
30
45

FINGERPRINT LOCK

FIELD OF THE INVENTION

The present invention relates to an electronic lock technical field, in particular, to a fingerprint lock.

BACKGROUND

Locks are daily necessities of life and widely used in people's lives. At present, the most widely used is pin tumbler lock. With the application of microelectronics technology, magnetic locks, acoustic control locks, ultrasonic locks, infrared locks, electromagnetic locks, electronic card locks, fingerprint locks, retinal locks and remote control locks have appeared.

Currently, fingerprint locks available in the markets are usually large, such as access control locks or household door locks mounted on the doors. These fingerprint locks with large size are used in special occasions, but not applied to other occasions.

SUMMARY

In order to overcome the above technical problems, the present invention provides a fingerprint lock for solving the problems of limited applications of fingerprint locks in the prior art.

To this end, the present invention provides a fingerprint lock, including a lock hook and a lock body, wherein, the lock body includes an upper housing, a lower housing, a main body and a fingerprint sensor component, the main body is located between the upper housing and the lower housing, and the upper housing is provided with a first opening; the upper housing and lower housing are in rectangle forms;

the main body includes a battery, a main board, a bracket, a speed-reducing motor, a cam, a lock tongue and a pin, wherein the speed-reducing motor is mounted on the main board through the bracket, the battery, main board, bracket and speed-reducing motor are located between the upper housing and the lower housing in sequence, and the lock tongue is connected to one end of the speed-reducing motor through the cam;

the fingerprint sensor component includes a sensor body and a sensor cover, the sensor body being located between the battery and the sensor cover, and the sensor cover being matched with the first opening and clamped in the first opening;

a first end of the lock hook is provided with a spring, and the first end is connected with the lock tongue by a snap spring and a movable touch block, and the lock hook is mounted on the upper housing.

Optionally, the fingerprint lock further includes a light-guiding structure, and the main board is provided with a light-guiding sheet and the upper housing includes a first light-guiding hole, the lower housing includes a second light-guiding hole, the light-guiding sheet matches the first light-guiding hole and the second light-guiding hole to form the light-guiding structure.

Optionally, the light-guiding sheet, the first light-guiding hole, and the second light-guiding hole are circular.

Optionally, the main board is provided with a USB module, and the fingerprint lock further includes a USB silicone rubber pad and a USB silicone rubber cover, the USB silicone rubber pad being snapped at the outer end of the USB module, the USB silicone rubber cover being located between the upper housing and the lower housing, and being located on the opposite side from the lock hook.

Optionally, the main board is provided with a USB module, and the fingerprint lock further includes a USB silicone rubber pad and a USB silicone rubber cover, the USB-silicone rubber cover being snapped at the outer end of the USB module, the USB silicone rubber cover being located between the upper housing and the lower housing, and being located on the opposite side from the lock hook; the light-guiding structure and the USB silicone rubber cover are located on the same side of the upper cover.

Optionally, a second opening is arranged in the middle of the sensor cover, and the sensor body includes a fingerprint acquisition area, the fingerprint acquisition area is exposed from the second opening.

Optionally, the sensor cover is rectangular, and the sensor cover is disposed at the center of the upper housing.

The fingerprint lock further includes a water-proof pad, and the water-proof pad is sheathed between the lock hook and the spring.

Optionally, the lower housing has at least four snap-in portions, each of the snap-in portions having a first pin hole, the upper housing having at least four second pin holes matching the first pin hole, and the pin passing through a pair of the matched first pin hole and second pin hole to fix the upper housing and the lower housing.

The fingerprint locks provided in the invention add the function of fingerprint identification on the basis of traditional locks, which can be used in any trial application, greatly extending the applications of fingerprint locks.

BRIEF DESCRIPTION OF THE DRAWINGS

In order to explicitly illustrate the technical solutions in the embodiments of the present invention or the prior art, the drawings used in the embodiments or prior art are described briefly. It will be apparent that the drawings in the following description are for some embodiments in the invention; those skilled in the art can obtain other accompanying drawings according to these drawings without making creative work.

FIG. 1 is a cross-sectional view of a fingerprint lock according to an embodiment of the present invention.

DETAILED DESCRIPTION

In order to make the objects, technical solutions and advantages of the embodiments of the present invention more explicit, the technical solutions of the embodiments herein will be clearly described in details in combination with the drawings in the embodiments. Apparently, these embodiments are partial rather than whole. All other embodiments obtained by those skilled in the art without making creative work are within the scope of the protection of the present invention, based on the embodiments of the present invention.

The embodiment provides a fingerprint lock, referring to FIG. 1, the fingerprint lock, including a lock hook and a lock body, wherein, the lock body includes an upper housing 15, a lower housing 7, a main body and a fingerprint sensor component, the main body is located between the upper housing 15 and the lower housing 7, and the upper housing 15 is provided with a first opening 30; and the upper housing 15 and lower housing are in rectangle forms;

the main body includes a battery 13, a main board 10, a bracket 9, a speed-reducing motor 8, a cam 6, a lock tongue 18; wherein the speed-reducing motor 8 is mounted on the main board 10 through the bracket 9, the battery 13, main board 10, bracket 9 and speed-reducing motor 8 are located between the upper housing 15 and the lower housing 7 in sequence, and the lock tongue 18 is connected to one end of the speed-reducing motor 8 through the cam 6;

the fingerprint sensor component includes a sensor body 16 and a sensor cover 17, the sensor body 16 being located between the battery 13 and the sensor cover 17, and the sensor cover 17 being matched with the first opening 30 and clamped in the first opening 30;

A first end 1*a* of the lock hook 1 is provided with a water-proof pad 2 and a spring 3. The first end 1*a* is connected to the lock tongue 18 through a snap spring 4 and a movable touch block 5, and the lock hook is mounted on the upper housing 15. Besides, the first end 1*a* of the lock hook 1 provided with spring is located between the upper housing and the lower housing.

The lower housing 7 has at least four snap-in portions, each of the snap-in portions having a first pin hole (not shown), the upper housing 15 having at least four second pin holes 35 matching the first pin hole, and the pin 14 passing through a pair of the matched first pin hole and second pin hole to fix the upper housing 15 and the lower housing 17.

In some embodiments, the fingerprint lock further includes a light-guiding structure, and the main board 10 is provided with a light-guiding sheet 19 and the upper housing 15 includes a first light-guiding hole 45, the lower housing 7 includes a second light-guiding hole 40, the light-guiding sheet 19 matches the first light-guiding hole 45 and the second light-guiding hole 40 to form the light-guiding structure. The light-guiding structure can transmit the lights emitted from internal LED point light to the surface of the fingerprint lock uniformly through the light-guiding materials and structures, playing a role of decorative appearance. In some embodiments, the light-guiding sheet can be made of light guiding plastics.

In some embodiments, a fingerprint lock further includes USB component, the main board 10 is provided with a USB module 50, and the fingerprint lock further includes a USB silicone rubber pad 11 and a USB silicone rubber cover 12, the USB-silicone rubber cover being snapped at the outer side of the USB module, the USB silicone rubber cover 12 being located between the upper housing 15 and the lower housing 7, and being located on the opposite side from the lock hook 1. The USB module, USB silicone rubber pad and USB silicone rubber cover jointly constitute a USB component. Through the USB component, you can charge the battery of lock using a commercially available mobile phone charging line (such as Android mobile phone charging line or iPhone mobile phone charging cable) and a charger, and update the system of fingerprint lock via the USB interface in the USB component (such as ex-factory burn or factory reset, etc.).

In addition, the light-guiding structure and the USB silicone rubber cover 12 are located on the same side of the upper housing 15.

In some embodiments, the sensor cover 17 can be rectangular, the sensor cover can be disposed at the center of the upper housing 15. The sensor cover can be a black plastic part. The sensor cover is used for installation and fixation of fingerprint sensor for fingerprints acquisition, for preventing the fingerprint sensor from direct contact with metal of the lock body to cause short circuit, playing a role of isolation and insulation. In addition, the difference between the black sensor cover and the metal part of lock body can bring unexpected visual effect for users.

In some embodiments, a second opening is arranged in the middle of the sensor cover 17, and the sensor body includes a fingerprint acquisition area, the fingerprint acquisition area is exposed from the second opening. In some embodiments, the second opening can be a rectangular structure. The exposed part of sensor body can constitute a fingerprint acquisition area of the fingerprint lock, which is used for acquisition of users' fingerprints. For example, when the fingerprint lock is used for the first time, user fingerprints can be acquired through this part for user's registration; and when this fingerprint lock used subsequently, the user's fingerprints acquired can be used to identify the user. In some embodiments, the fingerprint acquisition area can acquire the fingerprint information of users input by touching, pressing or sliding (sliding from left to right or from right to left, from top to bottom, or from bottom to top, etc.), etc.

In some embodiments, the working process of the fingerprint lock as shown in FIG. 1 can be as follows:

When the fingerprint lock is used for the first time, users can enter the fingerprint information through the fingerprint acquisition area, and the fingerprint lock stores the fingerprint information of users;

When acquisition of fingerprints in the fingerprint acquisition area again, the fingerprint is compared with the previously stored fingerprint information; and if they are consistent, start the fingerprint lock, and if not consistent, no operation is performed.

It should be noted that the lock hook in the above embodiment can be made of SUS304 stainless steel, the spring can be a piano spring, the movable touch block is made of ABS material, the snap spring is made of stainless steel, the lock tongue is made of ADC12 aluminum alloy, cam is made of PC material, the upper housing and lower housing are both made of ADC12 aluminum alloy, the USB silicone rubber pad and silicone rubber cover are made of silica gel, sensor cover is made of ABS material, battery is lithium battery, light-guiding sheet is made of PC material, bracket is a plastic bracket made of ABS material, and the pin is made of stainless steel.

The fingerprint locks provided in the embodiments of the invention add the function of fingerprint identification on the basis of traditional locks, which can be used in any trial application, greatly extending the applications of fingerprint locks.

Although preferred embodiments of the present invention have been described, those skilled in the art, upon learning of the basic inventive concept, may make additional alterations and modifications to these embodiments, including a combination of the above embodiments. Therefore, it is intended that the appended claims be interpreted as including preferred embodiments and all changes and modifications that fall within the scope of the invention.

It will be apparent to those skilled in the art that various changes and modifications can be made in the present invention without departing from the spirit and scope of the invention. Thus, it is intended that the present invention be construed as including such modifications and alterations insofar as they come within the scope of the appended claims and their equivalents.

What is claimed is:

1. A fingerprint lock, comprising a lock hook and a lock body, wherein, the lock body comprises an upper housing, a lower housing, a main body and a fingerprint sensor component, the main body is located between the upper housing and the lower housing, and the upper housing is provided with a first opening; the upper housing and lower housing are in rectangle forms;

the main body comprises a battery, a main board, a bracket, a speed-reducing motor, a cam, a lock tongue and a pin, wherein the speed-reducing motor is mounted on the main board through the bracket, the battery, main board, bracket and speed-reducing motor are located between the upper housing and the lower housing in sequence, and the lock tongue is connected to one end of the speed-reducing motor through the cam;

the fingerprint sensor component comprises a sensor body and a sensor cover, the sensor body being located between the battery and the sensor cover, and the sensor cover being matched with the first opening and clamped in the first opening;

a first end of the lock hook is provided with a spring, and the first end is connected with the lock tongue by pairing with a snap spring and a movable touch block, and the lock hook is mounted on the upper housing.

2. The fingerprint lock according to claim 1, wherein the fingerprint lock further comprises a light-guiding structure, and the main board is provided with a light-guiding sheet and the upper housing comprises a first light-guiding hole, the lower housing comprises a second light-guiding hole, the light-guiding sheet matches the first light-guiding hole and the second light-guiding hole to form the light-guiding structure.

3. The fingerprint lock according to claim 2, wherein the light-guiding sheet, the first light-guiding hole, and the second light-guiding hole are circular.

4. The fingerprint lock according to claim 2, wherein the main board is provided with a USB module, and the fingerprint lock further comprises a USB silicone rubber pad and a USB silicone rubber cover, the USB silicone rubber cover being snapped at the outer end of the USB module, the USB silicone rubber cover being located between the upper housing and the lower housing, and being located on the opposite side from the lock hook; the light-guiding structure and the USB silicone rubber cover are located next to one another on the upper housing.

5. The fingerprint lock according to claim 1, wherein the main board is provided with a USB module, and the fingerprint lock further comprises a USB silicone rubber pad and a USB silicone rubber cover, the USB silicone rubber pad being snapped at the outer end of the USB module, the USB silicone rubber cover being located between the upper housing and the lower housing, and being located on the opposite side from the lock hook.

6. The fingerprint lock according to claim 1, wherein a second opening is arranged in the middle of the sensor cover, and the sensor body comprises a fingerprint acquisition area, the fingerprint acquisition area is exposed from the second opening.

7. The fingerprint lock according to claim 1, wherein the sensor cover is rectangular, and the sensor cover is disposed at the center of the upper housing.

8. The fingerprint lock according to claim 1, wherein the fingerprint lock further comprises a water-proof pad, and the water-proof pad is sheathed between the lock hook and the spring.

9. The fingerprint lock according to claim 1, wherein the lower housing has at least four snap-in portions, each of the snap-in portions having a first pin hole, the upper housing having at least four second pin holes matching the first pin holes, and the pin passing through a pair of the matched first pin hole and second pin hole to fix the upper housing and the lower housing.

* * * * *